US009623457B2

(12) United States Patent
Wu et al.

(10) Patent No.: US 9,623,457 B2
(45) Date of Patent: Apr. 18, 2017

(54) DOUBLE COLD REDUCTION STRIP FOR SHADOW MASK AND PROCESS FOR PRODUCING THE SAME

(71) Applicant: BAOSHAN IRON & STEEL CO., LTD., Shanghai (CN)

(72) Inventors: Shoumin Wu, Shanghai (CN); Xiujun Li, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 146 days.

(21) Appl. No.: 14/382,072

(22) PCT Filed: May 17, 2013

(86) PCT No.: PCT/CN2013/075785
§ 371 (c)(1),
(2) Date: Aug. 29, 2014

(87) PCT Pub. No.: WO2014/000528
PCT Pub. Date: Jan. 3, 2014

(65) Prior Publication Data

US 2015/0099141 A1 Apr. 9, 2015

(30) Foreign Application Priority Data

Jun. 28, 2012 (CN) ..... 2012 1 0219534

(51) Int. Cl.
*C22C 38/04* (2006.01)
*C22C 38/06* (2006.01)
(Continued)

(52) U.S. Cl.
CPC ..... *B21B 13/22* (2013.01); *B21B 1/26* (2013.01); *B21B 1/28* (2013.01); *C21D 8/0226* (2013.01);
(Continued)

(58) Field of Classification Search
None
See application file for complete search history.

(56) References Cited

U.S. PATENT DOCUMENTS 4,586,965 A * 5/1986 Obara ..... C22C 38/06 148/651
6,117,253 A * 9/2000 Kim ..... C21D 8/0273 148/333
(Continued)

FOREIGN PATENT DOCUMENTS

CN 1340107 A 3/2002
CN 1343263 A 4/2002
(Continued)

OTHER PUBLICATIONS

Machine-English translation of DE112006001709, Li Jun et al., May 21, 2008.*
(Continued)

*Primary Examiner* — Deborah Yee
(74) *Attorney, Agent, or Firm* — Quarles & Brady LLP

(57) ABSTRACT

The present invention discloses a double cold reduction strip for shadow mask and a process for producing the same, comprising the following procedures: converter steelmaking→continuous billet casting→hot rolling→pickling and cold rolling→continuous annealing→double cold reduction→finishing and oiling. The weight percentages of essential elements of the shadow mask strip are: C: ≤0.001%, Mn: 0.10~0.40%, Al: 0.02~0.06%, Si: ≤0.025%, P: ≤0.015%, S: ≤0.01%, O: ≤0.004%, with remainders composed of Fe and inevitable impurities. Through the composition design for the elements in steel material according to the present invention, on the one hand, the weight percentage of carbon is controlled at a low level; on the other hand, the middle decarburization annealing process is omitted, the annealing temperature is declined, the production
(Continued)

Electro-sparking Ra=1.4μm PC=150/cm period is shortened and the production cost is reduced; through the optimization for rolling parameters and roller processing in the double cold reduction, procedures for degreasing and finishing are removed, and steels with excellent mechanical property and high surface quality are obtained.

17 Claims, 1 Drawing Sheet

(51) Int. Cl.

| | |
|---|---|
| ***C21D 8/02*** | (2006.01) |
| ***C21D 7/06*** | (2006.01) |
| ***C21D 7/02*** | (2006.01) |
| ***B21B 13/22*** | (2006.01) |
| ***B21B 1/26*** | (2006.01) |
| ***B21B 1/28*** | (2006.01) |
| ***C22C 38/00*** | (2006.01) |
| ***C22C 38/02*** | (2006.01) |

(52) U.S. Cl.
CPC ..... *C21D 8/0236* (2013.01); *C21D 8/0268* (2013.01); *C22C 38/002* (2013.01); *C22C 38/004* (2013.01); *C22C 38/02* (2013.01); *C22C 38/04* (2013.01); *C22C 38/06* (2013.01); *Y10T 428/12993* (2015.01)

(56) References Cited

U.S. PATENT DOCUMENTS

| | | | | |
|---|---|---|---|---|
| 6,946,041 | B2 * | 9/2005 | Sato | C22C 38/00 148/330 |
| 8,105,415 | B2 * | 1/2012 | McQuillis | C21C 5/54 75/508 |
| 2006/0145587 | A1 * | 7/2006 | Ueda | C21D 8/0226 313/402 |

FOREIGN PATENT DOCUMENTS

| | | | | |
|---|---|---|---|---|
| CN | 1141412 | C | | 3/2004 |
| CN | 1483089 | A | | 3/2004 |
| CN | 102719731 | A | | 10/2012 |
| EP | 1657321 | A1 | | 5/2006 |
| JP | EP0472194 | A2 | * | 2/1992 |
| JP | 07226168 | A | * | 8/1995 |
| WO | 2005017221 | A1 | | 2/2005 |

OTHER PUBLICATIONS

Machine-English translation of JP07226168A, Ueda Y, Aug. 22, 1995.*

Kopp, et al., Einfuhrung in die Umformtechnik, Title Page and p. 195, Copyright 1998 Reiner Kopp and Herbert Wiegels.

Deters, Metallurgie der Stahlherstellung, Title Page and pp. 63 and 76, Copyright 1989 Verlag Stahleisen Dusseldorf.

Stahl Eisen, Stahl Fibel, Herausgegeben vom Verein Deutscher Eisenhuttenleute, Title Page and pp. 51-57, 55-69, 74-78, 96-103, 112-113, 125, Copyright 1999 Verlag Stahleisen GmbH.

PCT International Search Report, PCT/CN2013/075785, Aug. 29, 2013, 5 pages.

* cited by examiner

Electro-sparking Ra=1.4 µm PC=150/cm

DOUBLE COLD REDUCTION STRIP FOR SHADOW MASK AND PROCESS FOR PRODUCING THE SAME

CROSS-REFERENCE TO RELATED APPLICATIONS

This application represents the national stage entry of PCT International Application No. PCT/CN2013/075785 filed May 17, 2013, which claims priority of Chinese Patent Application No. 201210219534.4, filed Jun. 28, 2012, the disclosures of which are incorporated by reference here in their entirety for all purposes.

FIELD OF THE INVENTION

The present invention relates to a double cold reduction strip for shadow mask, and in particular to an ultrathin and low-carbon double cold reduction strip for shadow mask; the present invention further relates to a process for producing double cold reduction strip for shadow mask, and in particular to a process of producing thin and low-carbon double cold reduction strip for shadow mask.

BACKGROUND OF THE INVENTION

Currently, the double cold reduction technology is typically adopted for manufacturing thin and ultralow-carbon strip products for shadow mask, which are commonly applied to the field of picture tube. Chinese patent application of publication No. CN1717502A relates to a process for producing shadow mask material, a shadow mask from the shadow mask material and a picture tube including the shadow mask. The contents of elements in a billet related in the process are designed as C: ≤0.004 wt. %, Si: ≤0.03 wt. %, Mn: 0.1-0.5 wt. %, P: ≤0.02 wt. %, S: ≤0.02 wt. %, Al: 0.01~0.07 wt. %, N: ≤0.0040 wt. %, B: ≤0.01 wt. %, Nb: ≤0.1 wt. % and Ti: 0.0001~0.1 wt. % with the remainders composed of Fe and unavoidable impurities. In the patent, the billet is subjected to hot rolling, pickling and cold rolling, further to continuous annealing or box annealing so as to regulate the content of residual C to 0.003 wt. % or less, and still further to double cold reduction at a rolling ratio of 20 to 92%, such that a material for shadow mask is obtained.

A Chinese patent for invention with granted publication No. CN1141412C provides a process, which adopts ultralow-carbon steel (pure iron) or adds to ultralow-carbon steel with a few strong carbide formation elements, Ti or Ti and Nb, such that the carbon therein is present in the form of carbide, with sharp reduction of the solid solution carbon in the steel and improvement of the aging resistance, which guarantees the performance of its stamping formation, especially, the formation uniformity. Through reasonable design for the chemical compositions and adjustment for the optimal processing parameters, the performance and magnetism of the strip material for shadow mask is capable to meet the operating requirements. Nevertheless, due to the addition of expensive alloy elements, the production cost of steelmaking increases substantially, and also because of the added alloy elements, in order to anneal completely, the annealing temperature has to be very high, thereupon the production energy consumption is large. Besides, the patent cannot produce shadow mask strip with a thickness of less than or equal to 0.15 millimeters.

SUMMARY OF THE INVENTION

The objective of the present invention is to provide a thin double cold reduction strip for shadow mask and a process for producing the same, such that the shadow mask strip features with good surface appearance and material performance.

To achieve the described objective, in the present invention, the weight percentages of chemical compositions of the strip material are designed as: C: ≤0.001%, Mn: 0.10~0.40%, Al: 0.02~0.06%, Si: ≤0.025%, P: ≤0.015%, S: ≤0.01%, O: ≤0.004%, with remainders composed of Fe and inevitable impurities; wherein, preferably, Mn: 0.10-0.30%.

Furthermore, the present invention optimizes the process for producing the double cold reduction strip for shadow mask, and the specific procedures are described as follows:

1) converter steelmaking, wherein ultralow-carbon-and-aluminum killed steel is adopted, the free oxygen F[O] in the converter ladle is controlled as 500~700 ppm, the element S in molten iron is controlled as less than or equal to 0.003% and the element P less than or equal to 0.035%, the target temperature of the converter ladle is 1540~1640° C., and the target free oxygen is 600 ppm, vacuum circulation degassing refine technology is utilized, and the decarburization time is 20~25 min;
2) continuous billet casting;
3) hot rolling;
4) pickling and cold rolling;
5) annealing by continuous annealing unit;
6) double cold reduction;
7) finishing and oiling;
8) shadow mask strip.

In general processes for producing double cold reduction shadow mask strip, the technical personnels adopt IF steels (interstitial free steels) for the reason that IF steels (interstitial free steels) is formed by adding a certain amount of strong carbonitride formation elements like Ti, Nb and solidifying completely the interstitial atom like C, N and the like, into carbonitrides during smelting, thereupon they are of good deep-drawing performance. Nevertheless, due to the addition of expensive alloy elements, the production cost of steelmaking increases substantially, and also because of the added alloy elements, in order to anneal completely, the annealing temperature has to be very high, thus the production energy consumption is large. Considering that no deep-drawing is needed during processing the shadow mask strip, researchers adopt ultralow-carbon-and-aluminum killed steel which is unnecessary to add the alloy elements like Nb, Ti. During steelmaking, the weight percentage of carbon is directly controlled as C less than or equal to 0.001% through composition design, which omits a "middle decarburization annealing process" and shortens the production period, on the one hand, ensuring the low cold brittleness and aging property as required by shadow mask apertures, and on the other hand, ensuring the strength as required by shadow mask strip after low-temperature annealing and double cold reduction.

1) Mn: adding a small amount of Mn in material is advantageous for improving strength, and Mn is capable of combining with S to form MnS, which can decrease the surface hot brittleness, avoiding the surface quality problems; nevertheless, adding too much Mn is adverse for stamping, thereby Mn should be controlled as 0.10~0.40%.
2) Al: Al is added as a deoxidizing agent during steelmaking for avoiding the increment of impurities in molten steel, especially, $Al_2O_3$, which may primarily affect the etching performance of shadow mask strip. The content of Al should be controlled as 0.02~0.06%.
3) Si: Si can improve the strength of the material, but during hot rolling, it is prone to producing eutectic scales of $SiO_2$.FeO with low melting point, which is difficult to remove with high-pressure water during hot rolling, thereby affecting the surface quality of the shadow mask strip. Accordingly, the content of Si should be controlled less than 0.025%.

4) P, S: the lower the weight percentage of P and S is, the better the mechanical property of the steel is; P can improve the strength of the material but result in the brittleness thereof yet. S is a hazardous element, which may form impurities harmful to the etching performance of the shadow mask strip. Accordingly, the content of P, S should be as low as possible. Typically, P is controlled less than 0.015%; and S is controlled less than 0.010%.

5) O: O is a hazardous element, which is prone to forming compounds, such as FeO, therefore, its content should be controlled at a low level.

First, during steelmaking, compositions of materials are controlled as mentioned above, and [S] in the molten iron is controlled as less than or equal to 0.003% and [P] less than or equal to 0.035%, the free oxygen F[O] in the converter ladle is controlled as 500~700 ppm, the target free oxygen is 600 ppm, and the target temperature of the converter ladle is 1540~1640° C. Vacuum circulation degassing refine technology is adopted, and the decarburization target time is 20~25 min.

Then, during continuous casting, ultralow-carbon covering flux is adopted in the middle ladle for avoiding the increment of carbon. Ultralow-carbon casting powder is adopted in crystallizers. It is ensured that stuffing sand in the ladle is carbon-free and complete argon blowing is operated. Main impurities in shadow mask strip are oxides with Al, Ca, Mn, Si, S and the like. Owing to the different etching speed of the impurities from the substrate ferrites at the position, the etching performance of the shadow mask strip may be affected, resulting in irregular shapes of etching apertures. Because there are hundreds of thousands of apertures on each shadow mask sheet and the distance therebetween is very small, the existence of mass and large impurities thereon can reduce the proportion of qualified shadow mask sheets and lead to the undesirable purity degree of steel material. Besides, impurities may deteriorate the soft magnetism of the shadow mask sheets. Accordingly, it is typically expected in shadow mask strip, that the content of C is less than or equal to 20 ppm, steel is pure with stable and uniform compositions, and impurities are less than or equal to $0.03/m^2$, the size thereof less than or equal to 30 μm.

Then, during hot rolling, the temperature of heating furnace is 1190~1250° C., and the time that the billet is kept for therein, is 4~6 hours, so as to ensure the interior and exterior temperatures of the billet uniform. It should be noted that on the one hand, the temperature should not be too high, otherwise too much AlN solution formed may result in the increment of scales; on the other hand, the temperature should not be too low, otherwise the finish rolling temperature may be unable to be regulated stably. Hence the finish rolling temperature is determined to be 900~940° C., which not only ensures the temperature is above $Ar_3$, but also guarantees the temperature uniformity of the billet among head, middle, tail and in the width, avoiding the generation of mixed crystals and coarse-grains. Coiling temperature is determined as 660~700° C., and the temperatures at head and tail should be regulated stably. The shape of the sheet: the crown is 10~40 μm, and the target thereof is 20 μm; the cross section is smooth without big wedges and local high points as well as flat crowns.

Subsequently, during pickling and cold rolling, for meeting the requirements of the thickness on finished products and the manufacturability of hot rolling, surface scales on strips are eliminated via pickling, and the deformation rate thereof during cold rolling is set at around 90%. During annealing in continuous annealing unit: the target temperature in heating zone is between 580~600° C., and in soaking zone between 580~600° C., and the target speed of the unit is 500~650 m/min.

Then, double cold reduction (DCR) is performed, which has the following functions:

1) increasing the strength and hardness of the shadow mask strip after high temperature annealing;
2) improving the sheet shape, so as to obtain good flatness;
3) imparting appropriate appearance to the strip surface, with parameters including $R_a$, $R_{max}$, $S_m$, $R_{sk}$ and the like.

The surface quality of the shadow mask strip determines the function of color selection (color separation) which is crucial to picture tube applications. The surface quality criterions of strip consists primarily of surface defect status, cleanliness, and appearance (including technical parameters such as average surface roughness $R_a$, maximum peak-to-valley distance $R_{max}$, wave peak pitch $S_m$, degree of skewness $R_{sk}$, etc.).

It is desirable that the appearance of shadow mask strip should be even and exquisite and any surface defects are not allowed. The average surface roughness of shadow mask strip is expected to be appropriate; if it is too high, after etching, aperture edges of the strip are not smooth, and little jags may be formed; if it is too low, the adhesion between strips and sensitive films is poor, then the sensitive films are prone to dropping, and the air suction performance between pre-exposure master mask and strip tends to be affected, even resulting in poor exposure. The skewness $R_{sk}$ indicates in essence the distribution of peaks and valleys relative to the surface profile base in a certain length. When $R_{sk}$ is more than or equal to 0, roughness presents as many crowns on the strip surface, thereby there are a lot of gas channels between the upper and lower working substrate and strips, convenient for vacuuming, such that the vacuuming time can be shortened; besides, owing to many recesses and crowns on the strip surface, the adhesion between sensitive films and strip is better; on the contrary, when $R_{sk}$ is less than or equal to 0, roughness presents as many plane areas on the strip surface, with few recesses and crowns, especially, valleys, thereby there are a small amount of gas channels between the working substrate and strips, inconvenient for vacuuming; besides, the adhesion between sensitive films and strip is poor. Maximum peak-to-valley distance $R_{max}$ and wave peak pitch $S_m$, indicates the degree of the evenness and exquisiteness of the surface appearance, that is, the larger the value of $R_{max}$, the poorer the evenness, and the larger the value of $S_m$, the more exquisite the surface. In the present invention, during double cold reduction, for reaching the aforementioned value of the surface appearance, the parameters are specifically controlled as: $R_a$ 0.40~0.70 μm, $R_{max}$ less than or equal to 6.0 μm, $R_{sk}$, more than or equal to 0, $S_m$ 50~130 μm.

For obtaining good quality of the strip surface, the double cold reduction in the present invention adopts, preferably, two-stand double cold reduction mill, in which the first stand has a rolling force of 4,000~6,000 KN, the work rollers are processed by means of grinding, and the surface roughness thereof is controlled as 0.20~0.40 μm; the second stand has a rolling force of 2,000~4,000 KN, the work rollers are processed by means of electro-sparking, and the surface roughness thereof is controlled as 1.3~1.5 μm. The diameters of the work rollers in both stands are 410~460 mm, and the surface hardness of the work rollers is Hs 93~97, the surface hardness of the middle rollers is Hs 81~85, the tension force per unit at the entry of the two-stand skin-pass mill is 13~16 kg/mm$^2$, and the tension force per unit in the middle and at the exit thereof is 18~25 kg/mm$^2$. According to the maximum deformation ability of the double cold reduction mill, the deformation rate is designed as 35~42%.

The surface appearance of the work rollers of the second stand in the double cold reduction is a crucial process, and the surface roughness thereof after electro-sparking is required to be 1.3~1.5 μm, the range of PC (peak count per length unit) should be controlled as 130~170/cm.

Mechanical properties of shadow mask strip are composed primarily of yield strength, tensile strength, hardness, elongation and yield-point-elongation (YPE) before and after annealing, especially, the yield-point-elongation after annealing. When the shadow mask strip is applied to the field of picture tube, it is desirable that the size of sheet aperture is precise and the shape thereof is stable. Therefore, for keeping the deforming evenness of the shadow mask sheets during stamping, it is desirable that the YPE of the shadow mask strip after recrystallization annealing presents as low as possible. For shadow mask sheets, the mechanical property is mainly measured by the yield strength thereof. On the one hand, lower yield strength can give rise to better mechanical property and improve the stability of the stamped shape; on the other hand, high yield strength and hardness can result in that the shadow mask strip is not liable to deform (e.g. edge waves and folds) during subsequent processing (processes such as degreasing, preprocessing, coating, exposing, developing, etching and the like). To achieve the mechanical property of products and avoid the deformation during subsequent processing, the material for shadow mask strip needs a suitable yield strength, typically 440~470 MPa. To obtain the appropriate yield strength, the deformation rate is designed as 35~42% according to the maximum deforming capacity of the double cold reduction mill.

composition design for the elements in steel material, on the one hand, the weight percentage of carbon is controlled at a low level, ensuring the cold brittleness and the aging property thereof during subsequent processes; on the other hand, the middle decarburization annealing process is removed, the annealing temperature is declined and the production period is shortened; 2) through the optimization for rolling parameters and roller processing in the double cold reduction, procedures for degreasing and finishing are removed, and steels with excellent mechanical property and high surface quality are obtained for subsequently producing thin and low-carbon shadow mask strip. The present invention has no need to perform decarburization, nor adding expensive alloy elements, not only simplifying the production, but also obtaining shadow mask strip with good surface quality and operating performance; furthermore, due to the features of short processing time and low production cost, the present invention is appropriate for industrial production for various manufacturers.

DETAILED DESCRIPTION OF THE INVENTION

Depending on different process parameters in the present invention, 5 embodiments are shown to further describe the present invention and the related parameters to the process for producing the present invention.

| Embodiment A | | | | | | | | | |
|---|---|---|---|---|---|---|---|---|---|
| Composition Design (wt %) | C (%) | Si (%) | Mn (%) | P (%) | S (%) | O (%) | Al (%) | Ti (%) | Nb (%) |
| | 0.0008 | 0.020 | 0.36 | 0.013 | 0.0076 | 0.003 | 0.042 | / | / |
| Temperature Parameters in Hot Rolling | Hot Rolling | | | | | | | | |
| | Heating Furnace Temperature (° C.) | | | Finish Rolling Temperature (° C.) | | | | Coiling Temperature (° C.) | |
| | 1198 | | | 915 | | | | 683 | |
| Temperature Parameters in Cold Rolling | Annealing in Cold Rolling | | | | | | | | |
| | Target Temperature in Heating Zone (° C.) | | | Target Temperature in Soaking Zone (° C.) | | | | Rolling Speed (m/min) | |
| | 596 | | | 582 | | | | 610 | |
| Parameters for Two Stand Mill Sets | | Diameter of Work Roller (mm) | Rolling Force (KN) | Hardness of Roller Surface (Hs) | Way of Roller Processing | Parameters for Double cold reduction | | | |
| | First Stand | 452 | 5274 | 95 | Grinding | Tension Force per Unit (kg/mm$^3$) | | Deformation Rate | |
| | | | | | | Entry | Middle And Exit | | |
| | Second Stand | 436 | 3728 | 94 | Electro-sparking | 14 | 21 | 37 | |
| Parameters for Work Rollers | Surface Roughness of Work Rollers of Two Stand Mill in Double Cold Reduction | | | | | | | | |
| | The First Stand | | | | | The Second Stand | | | |
| | 0.32 | | | | | 1.33 | | | |
| Elongation of Tension Leveler | Elongation of Tension Leveler (%) | | | | | | | | |
| | 0.65 | | | | | | | | |

Finally, a tension leveler is adopted in the finishing line, and the range of its elongation is set to be 0.40~1.0%.

The present invention has the advantages that 1) through the adoption of ultralow-carbon-aluminum killed steel unnecessary to add alloy elements like Nb, Ti, and the Finally, qualified products are obtained, with tensile strength of 510 MPa, yield strength of 464 MPa, elongation of 2.5%, surface roughness of 0.416 μm, $R_{max}$ of 3.337 μm, $S_m$ of 66.582 μm, $R_{sk}$ of 0.201, HV of 160 and shape wave of less than 2 mm.

Figure 1:
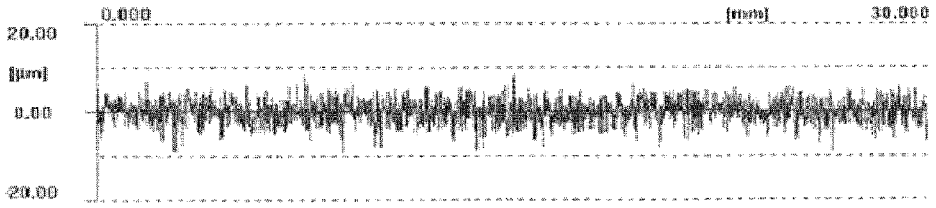
FIG. 1 is the schematic diagram showing the surface roughness of electro-sparked work rollers of the second stand in double cold reduction.
Figure 2:
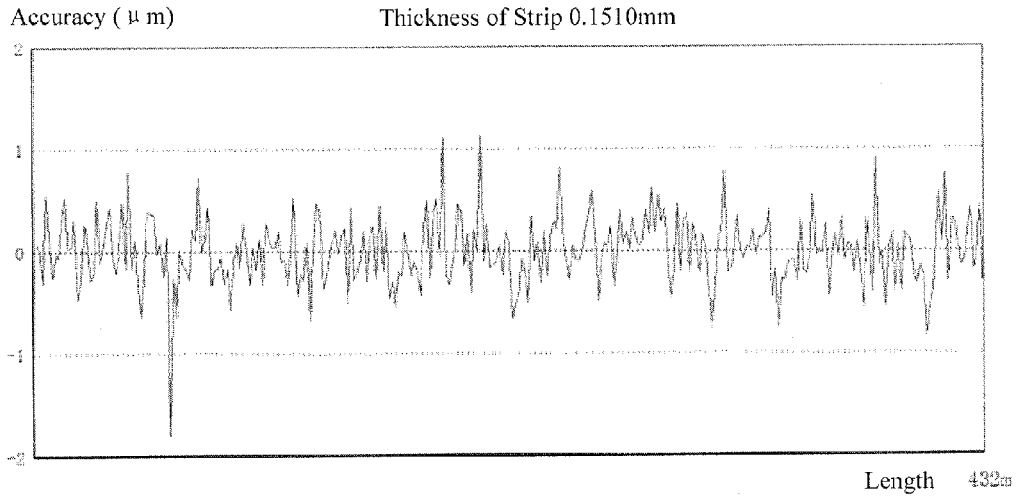
FIG. 2 is the schematic diagram showing the thickness accuracy of shadow mask strip produced according to Embodiment A of the present invention.

The thickness accuracy of the shadow mask strip according to this embodiment is shown in FIG. 2.

| Embodiment B | | | | | | | | | |
|---|---|---|---|---|---|---|---|---|---|
| Composition Design (wt %) | C (%) | Si (%) | Mn (%) | P (%) | S (%) | O (%) | Al (%) | Ti (%) | Nb (%) |
| | 0.0009 | 0.020 | 0.25 | 0.010 | 0.0082 | 0.002 | 0.051 | / | / |
| Temperature Parameters in Hot Rolling | Hot Rolling | | | | | | | | |
| | Heating Furnace Temperature (° C.) | | | | Finish Rolling Temperature (° C.) | | | Coiling Temperature (° C.) | |
| | 1221 | | | | 924 | | | 679 | |
| Temperature Parameters in Cold Rolling | Annealing in Cold Rolling | | | | | | | | |
| | Target Temperature in Heating Zone (° C.) | | | | Target Temperature in Soaking Zone (° C.) | | | Rolling Speed (m/min) | |
| | 592 | | | | 588 | | | 594 | |
| Parameters for Two Stand Mill Sets | | Diameter of Work Roller (mm) | Rolling Force (KN) | Hardness of Roller Surface (Hs) | Way of Roller Processing | Parameters for Double cold reduction | | | |
| | First Stand | 443 | 5683 | 94 | Grinding | Tension Force per Unit ($kg/mm^3$) | | Deformation Rate (%) | |
| | | | | | | Entry | Middle And Exit | | |
| | Second Stand | 431 | 3842 | 95 | Electro-sparking | 14 | 20 | 38 | |
| Parameters for Work Rollers | Surface Roughness of Work Rollers of Two Stand Mill in Double Cold Reduction | | | | | | | | |
| | The First Stand | | | | | The Second Stand | | | |
| | 0.30 | | | | | 1.40 (PC 150) | | | |
| Elongation of Tension Leveler | Elongation of Tension Leveler (%) | | | | | | | | |
| | 0.7 | | | | | | | | |

Finally, qualified products are obtained, with tensile strength of 530 MPa, yield strength of 458 MPa, elongation of 2.2%, surface roughness of 0.404 μm, $R_{max}$ of 3.432 μm, $S_m$ of 61.392 μm, $R_{sk}$ of 0.215, HV of 157 and shape wave of less than 2.5 mm.

| Embodiment C | | | | | | | | | |
|---|---|---|---|---|---|---|---|---|---|
| Composition Design (wt %) | C (%) | Si (%) | Mn (%) | P (%) | S (%) | O (%) | Al (%) | Ti (%) | Nb (%) |
| | 0.0007 | 0.022 | 0.30 | 0.012 | 0.0092 | 0.001 | 0.048 | / | / |
| Temperature Parameters in Hot Rolling | Hot Rolling | | | | | | | | |
| | Heating Furnace Temperature (° C.) | | | | Finish Rolling Temperature (° C.) | | | Coiling Temperature (° C.) | |
| | 1235 | | | | 937 | | | 682 | |
| Temperature Parameters in Cold Rolling | Annealing in Cold Rolling | | | | | | | | |
| | Target Temperature in Heating Zone (° C.) | | | | Target Temperature in Soaking Zone (° C.) | | | Rolling Speed (m/min) | |
| | 592 | | | | 588 | | | 594 | |
| Parameters for Two Stand Mill Sets | | Diameter of Work Roller (mm) | Rolling Force (KN) | Hardness of Roller Surface (Hs) | Way of Roller Processing | Parameters for Double cold reduction | | | |
| | First Stand | 440 | 5543 | 94 | Grinding | Tension Force per Unit ($kg/mm^3$) | | Deformation Rate (%) | |
| | | | | | | Entry | Middle And Exit | | |
| | Second Stand | 427 | 3759 | 95 | Electro-sparking | 14 | 20 | 38 | |
| Parameters for Work Rollers | Surface Roughness of Work Rollers of Two Stand Mill in Double Cold Reduction | | | | | | | | |
| | The First Stand | | | | | The Second Stand | | | |
| | 0.26 | | | | | 1.30 (PC 160) | | | |
| Elongation of Tension Leveler | Elongation of Tension Leveler (%) | | | | | | | | |
| | 0.91 | | | | | | | | |

Finally, qualified products are obtained, with tensile strength of 541 MPa, yield strength of 464 MPa, elongation of 2.6%, surface roughness of 0.442 μm, $R_{max}$ of 3.425 μm, $S_m$ of 61.279 μm, $R_{sk}$ of 0.221, HV of 163 and shape wave of less than 2.6 mm.

| Embodiment D | | | | | | | | | |
|---|---|---|---|---|---|---|---|---|---|
| Composition Design (wt %) | C (%) | Si (%) | Mn (%) | P (%) | S (%) | O (%) | Al (%) | Ti (%) | Nb (%) |
| | 0.0008 | 0.017 | 0.15 | 0.009 | 0.0085 | 0.002 | 0.034 | / | / |

-continued

| Embodiment D | | | | | | | |
|---|---|---|---|---|---|---|---|
| Temperature Parameters in Hot Rolling | Hot Rolling | | | | | | |
| | Heating Furnace Temperature (° C.) | | | Finish Rolling Temperature (° C.) | | Coiling Temperature (° C.) | |
| | 1241 | | | 925 | | 671 | |
| Temperature Parameters in Cold Rolling | Annealing in Cold Rolling | | | | | | |
| | Target Temperature in Heating Zone (° C.) | | | Target Temperature in Soaking Zone (° C.) | | Rolling Speed (m/min) | |
| | 596 | | | 591 | | 565 | |
| Parameters for Two Stand Mill Sets | | Diameter of Work Roller (mm) | Rolling Force (KN) | Hardness of Roller Surface (Hs) | Way of Roller Processing | Parameters for Double cold reduction | |
| | First Stand | 438 | 5831 | 95 | Grinding | Tension Force per Unit (kg/mm$^3$) Entry / Middle And Exit | Deformation Rate (%) |
| | Second Stand | 441 | 3952 | 96 | Electro-sparking | 15 / 22 | 38 |
| Parameters for Work Rollers | Surface Roughness of Work Rollers of Two Stand Mill in Double Cold Reduction | | | | | | |
| | The First Stand | | | | The Second Stand | | |
| | 0.25 | | | | 1.32 (PC 158) | | |
| Elongation of Tension Leveler | Elongation of Tension Leveler (%) | | | | | | |
| | 0.8 | | | | | | |

Finally, qualified products are obtained, with tensile strength of 521 MPa, yield strength of 457 MPa, elongation of 2.5%, surface roughness of 0.439 μm, $R_{max}$ of 4.276 μm, $S_m$ of 71.374 μm, $R_{sk}$ of 0.186, HV of 155 and shape wave of less than 1.6 mm.

| Embodiment E | | | | | | | | | |
|---|---|---|---|---|---|---|---|---|---|
| Composition Design (wt %) | C (%) | Si (%) | Mn (%) | P (%) | S (%) | O (%) | Al (%) | Ti (%) | Nb (%) |
| | 0.0006 | 0.019 | 0.10 | 0.010 | 0.0081 | 0.003 | 0.025 | / | / |
| Temperature Parameters in Hot Rolling | Hot Rolling | | | | | | | | |
| | Heating Furnace Temperature (° C.) | | | Finish Rolling Temperature (° C.) | | | Coiling Temperature (° C.) | | |
| | 1221 | | | 918 | | | 688 | | |
| Temperature Parameters in Cold Rolling | Annealing in Cold Rolling | | | | | | | | |
| | Target Temperature in Heating Zone (° C.) | | | Target Temperature in Soaking Zone (° C.) | | | Rolling Speed (m/min) | | |
| | 589 | | | 583 | | | 580 | | |
| Parameters for Two Stand Mill Sets | | Diameter of Work Roller (mm) | Rolling Force (KN) | Hardness of Roller Surface (Hs) | Way of Roller Processing | Parameters for Double cold reduction | | | |
| | First Stand | 422 | 4843 | 94 | Grinding | Tension Force per Unit (kg/mm$^3$) Entry / Middle And Exit | | Deformation Rate (%) | |
| | Second Stand | 415 | 2716 | 96 | Electro-sparking | 14 / 21 | | 34 | |
| Parameters for Work Rollers | Surface Roughness of Work Rollers of Two Stand Mill in Double Cold Reduction | | | | | | | | |
| | The First Stand | | | | The Second Stand | | | | |
| | 0.35 | | | | 1.48 (PC 164) | | | | |
| Elongation of Tension Leveler | Elongation of Tension Leveler (%) | | | | | | | | |
| | 0.42 | | | | | | | | |

Finally, qualified products are obtained, with tensile strength of 523 MPa, yield strength of 463 MPa, elongation of 2.5%, surface roughness of 0.446 μm, $R_{max}$ of 4.193 μm, $S_m$ of 73.193 μm, $R_{sk}$ of 0.182, HV of 150 and shape wave of less than 1.6 mm.

The invention claimed is:

1. A double cold rolled shadow mask strip steel, designed to consist of, in weight percentage, C: <0.001%, Mn: 0.1~0.40%, Al: 0.02~0.06%, Si: <0.025%, P: <0.015%, S: <0.01%, O: <0.004%, with remainders composed of Fe and inevitable impurities.

2. The double cold rolled shadow mask strip steel according to claim 1, characterized in that the weight percentage of Mn is 0.10~0.30%.

3. The double cold rolled shadow mask strip steel according to claim 1, characterized in that the average surface roughness $R_a$ thereof is 0.40~0.70 μm, the maximum peak-to-valley distance $R_{max}$ is less than or equal to 6.0 μm, the skewness $R_{sk}$ is more than or equal to 0, and the wave peak pitch $S_m$ is 50~130 μm.

4. A process for producing the double cold rolled shadow mask strip steel of claim 1, characterized in that, the process comprises following steps:

1) converter steelmaking, wherein ultralow-carbon-and-aluminum killed steel is adopted, the free oxygen F[O] in converter ladle is regulated to be 500~700 ppm, the element S in molten iron is regulated to be less than or equal to 0.003% and the element P is regulated to be less than or equal to 0.035%, the converter ladle has a target temperature between 1540~1640° C., and the target free oxygen is 600 ppm, vacuum circulation degassing refine technology is utilized, and the decarburization time is 20~25 min;

2) continuous billet casting;

3) hot rolling;

4) pickling and cold rolling;

5) continuous annealing;

6) double cold reduction;

7) finishing and oiling.

5. The process for producing the double cold rolled shadow mask strip steel according to claim 4, characterized in that, during the hot rolling, the temperature of heating furnace is set to be 1190~1250° C., the time that the billet is kept for therein is set to be 4~6 hours, the finish rolling temperature is set to be 900~940° C. and the steel is coiled at a coiling temperature between 660~700° C.

6. The process for producing the double cold rolled shadow mask strip steel according to claim 4, characterized in that, during the continuous billet casting, carbon-free stuffing sand is adopted in ladle, the process of complete argon blowing is utilized, and ultralow-carbon covering flux is adopted to prevent the increment of carbon in the middle ladle.

7. The process for producing the double cold rolled shadow mask strip steel according to claim 4, characterized in that, during the annealing, the target temperature in heating zone is set to be 580~600° C., the target temperature in soaking zone is set to be 580~600° C., and the target speed of continuous annealing unit is set to be 500~650 m/min.

8. The process for producing the double cold rolled shadow mask strip steel according to claim 4, characterized in that, during the double cold reduction, a two-stand mill is adopted.

9. The process for producing the double cold rolled shadow mask strip steel according to claim 8, characterized in that, a rolling force of the first stand of the two-stand mill is set to be 4,000~6,000 KN.

10. The process for producing the double cold rolled shadow mask strip steel according to claim 8, characterized in that, a rolling force of the second stand of the two-stand mill is set to be 2,000~4,000 KN.

11. The process for producing the double cold rolled shadow mask strip steel according to claim 8, characterized in that, a tension force per unit at the entry of the two-stand mill is regulated to be 13~16 kg/mm$^2$, and a tension force per unit in the middle and at the exit thereof is regulated to be 18~25 kg/mm$^2$.

12. The process for producing the double cold rolled shadow mask strip steel according to claim 8, characterized in that a diameter of the work rollers of the two-stand mill is 410~460 mm.

13. The process for producing the double cold rolled shadow mask strip steel according to claim 8, characterized in that a surface hardness of the work rollers of the two-stand mill is Hs 93~97, and a surface hardness of the middle rollers is Hs 81~85.

14. The process for producing the double cold rolled shadow mask strip steel according to claim 4, characterized in that, a deformation rate in double cold reduction is designed to be 35~42%.

15. The process for producing the double cold rolled shadow mask strip steel according to claim 8, characterized in that, grinded work rollers are adopted as work rollers of the first stand of the two-stand mill, a surface roughness of which is 0.20~0.40 μm.

16. The process for producing the double cold rolled shadow mask strip steel according to claim 8, characterized in that, electro-sparked work rollers are adopted as work rollers of the second stand of the two-stand mill, the surface roughness of which is 1.3~1.5 μm, and the peak count per centimeter thereof is 130~170.

17. The process for producing the double cold rolled shadow mask strip steel according to claim 4, characterized in that, a tension leveler is adopted for the finishing and oiling operation, and its elongation is set to be 0.40~1.0%.

* * * * *